US008449256B2

(12) United States Patent
Bianchi

(10) Patent No.: US 8,449,256 B2
(45) Date of Patent: May 28, 2013

(54) VARIABLE-PITCH PROPELLER

(75) Inventor: Massimiliano Bianchi, Milan (IT)

(73) Assignee: Max Prop S.R.L., Milan (IT)

( * ) Notice: Subject to any disclaimer, the term of this patent is extended or adjusted under 35 U.S.C. 154(b) by 930 days.

(21) Appl. No.: 12/520,056

(22) PCT Filed: Dec. 19, 2007

(86) PCT No.: PCT/IB2007/004002
§ 371 (c)(1),
(2), (4) Date: Aug. 10, 2009

(87) PCT Pub. No.: WO2008/075187
PCT Pub. Date: Jun. 26, 2008

(65) Prior Publication Data

US 2010/0040469 A1 Feb. 18, 2010

(30) Foreign Application Priority Data

Dec. 19, 2006 (IT) ..... MI2006A2440
Dec. 19, 2006 (IT) ..... MI2006A2442

(51) Int. Cl.
*B63H 3/00* (2006.01)

(52) U.S. Cl.
USPC ..... 416/43; 416/50; 416/52

(58) Field of Classification Search
USPC ..... 415/30; 416/27, 43, 44, 50, 51, 52, 416/140, 136, 139
See application file for complete search history.

(56) References Cited

U.S. PATENT DOCUMENTS 3,403,735 A * 10/1968 Langhjelm et al. ..... 416/140
5,032,057 A 7/1991 Speer
5,326,223 A 7/1994 Speer
5,562,413 A 10/1996 Aihara et al.

FOREIGN PATENT DOCUMENTS

DE 20308350 U1 8/2003
WO 90/11221 A 10/1990

* cited by examiner

*Primary Examiner* — Dwayne J White
(74) *Attorney, Agent, or Firm* — Lucas & Mercanti, LLP

(57) ABSTRACT

Variable-pitch propeller (1) of the type comprising at least one blade (6*a*, 6*b*, 6*c*) rotatably pivoted (20*a*, 20*b*, 20*c*) to a cylindrical casing of the propeller (3*a*, 3*b*, 4), a shaft coupled to an engine and coaxial to that propeller casing, a kinematic system (7, 8*a*, 8*b*, 8*c*, 10*a*, 10*b*, 10*c*, 11), coupled to the shaft, or to the propeller casing, and to above mentioned at least one blade, for regulating the rotary motion of said at least one blade around its own pivot axis to the propeller casing, as well as means (2, 14, 15) for transmitting the rotary motion of the shaft to the propeller casing, the propeller being shaped to provide at least one not null angular range for the free relative rotation of the above mentioned at least one blade (6*a*, 6*b*, 6*c*) around its pivot axis, relatively to the propeller casing (3*a*, 3*b*, 4). The propeller also comprises at least one elastic element (18, 18') countering the relative rotation of said at least one blade relatively to the propeller casing (3*a*, 3*b*, 4), or vice versa.

18 Claims, 9 Drawing Sheets

401
406a
420a
410a
411a
418
403
402
422
411b
407
428
405
406b 501
502
503
505
506a
506b
507
510a
511
518a
520a
522
528

VARIABLE-PITCH PROPELLER

This application is a 371 of PCT/IB2007/004002 filed on Dec. 19, 2007, which claims the benefit of Italian Patent Application Nos. M12006A002440 filed on Dec. 19, 2006 and M12006A002442 filed on Dec. 19, 2006, the contents of each of which are incorporated herein by reference.

FIELD OF THE INVENTION

The present invention refers to a propeller, preferably, but not exclusively, for marine use, of the so called variable-pitch type, wherein namely the fluid dynamic pitch of the blades might be changed while operating, thereby rendering extremely efficient the propeller itself upon the conditions wherein the latter is operating would change.

BACKGROUND ART

Variable-pitch propellers are particularly known, wherein the pitch is given automatically by activating the propeller itself, comprising a cylindrical propeller casing, on which the propeller blades are pivoted according to a cross direction relatively to the propeller casing axis itself, a shaft, that is coupled coaxially to the propeller casing, means for transmitting the rotary movement from the shaft to the propeller casing, as well as a kinematic system for regulating the rotary motion of each blade around its own pivot axis to the propeller casing, preferably adapted to transform the rotary motion of the shaft in a rotary motion of each blade around its own pivot axis.

To allow the afore mentioned kinematic system activation to transform the shaft rotation in the blade rotation, the transmission motion means provide that the shaft might turn in ad idle manner relatively to the propeller casing, at least for an angular predefined range. The idle rotation of the shaft in such an angular range, the propeller casing being substantially stationary most of all because of friction, causes, thanks to the afore mentioned kinematic system of regulation/transformation, the relative rotation of the blades relatively to the propeller casing, inducing the consequent variation of their pitch.

Such a propeller type of the known art might as well provide that the blades, when the torque on the shaft will fail, and because of the fluid dynamic stresses to which the propeller itself is subjected, could be free of disposing in a "rest" configuration, predefined during the designing step.

For example, in the case of motorboat engines, such a rest configuration corresponds to a predefined propeller pitch, whereas, in the case of sailing boats provided with auxiliary engines, when the torque will fail, the propeller is free to dispose in the "feathered" position, that is to offer the smallest fluid dynamic resistance is possible (propeller disposed according to an infinite pitch).

To such a "rest" arrangement of the blade corresponds as well, the consequent shaft arrangement at the beginning of the angular range of free rotation between the shaft and the propeller casing, thanks to the integral kinematic system of transformation, so that when the shaft will be subjected to a torque again, it will turn idly relatively to such a propeller casing in the afore mentioned angular range, causing the corresponding blade rotation according to the desired pitch.

The Italian patent IT 1 052 002, in the name of Massimiliano Bianchi, teaches to realize such a variable-pitch propeller in the feathered position, particularly for sailing boats, wherein the shaft and the propeller casing are mutually coupled by two coplanar teeth and that are orthogonal to the propeller axis itself. When the propeller blades are in the feathered position, being the propeller stationary, such a teeth are spaced out so that the rotationally subsequent shaft activation, whether in a sense or in the countersense, will cause its idle rotation for some angular range, to which the blade rotation corresponds relatively to the cylindrical casing and then the pitch changing thereof, thanks to an appropriate kinematic system of the pinion and gear wheel type.

Although such a propeller is very simple, and thereby strong, referring to a structural aspect, and provides that the propeller blades might dispose automatically according to a first pitch, that is according to a certain incidence angle relatively to the shaft, being adapted to the boat advance and according to a different pitch, adapted to the boat moving backwards, by such a propeller it is not possible to obtain a discrete or continuous variation of the pitch upon varying the operating conditions of the propeller itself.

That is, during the designing step once the most convenient blade pitch for the ahead movement is determined, and the most convenient pitch for the astern movement of the boat is determined, that is given, in addition to the blade shapes, also by their the rotation angle relatively to the propeller cylindrical casing, it is not more possible for the operator to change such a rotation angle for modifying the pitch during the propeller operation.

To compensate for such a drawback, variable-pitch propeller have been proposed, wherein the blade rotation relatively to the propeller casing, around their pivot axis on the latter, is driven by a mechanism that, not being integral with the shaft, but at most cooperating with it, might be manually operated also during the propeller operation itself.

For example, the European Application EP 0 328 966 A1 in the name of BIANCHI, teaches to realize such a mechanism, wherein a fluidic operated ram induces the shift of a toothed sleeve that, conveniently shaped, allows the pinion rotation, engaged in turn with the gear wheels that are integral to the blades. Ram manually operating causes the pinion and gear wheels rotation, thereby defining the incidence angle variation of the same blades, relatively to the shaft.

Such a solution, even if allowing the operator to dispose the propeller blades according to the most efficient pitch, according to the propeller operating conditions, provides that the operator will manually determine such a propeller pitch and thereby will impose to the operator a never ending attention to such an operating conditions, on the other hand without the guarantee of obtaining an optimal propeller efficiency, because of the discretion of such a manual operation.

It is an object of the present invention to realize a variable-pitch propeller, for example of the feathered type, that would not present the afore mentioned drawbacks of the known art, and therefore that would allow an efficient variation of its pitch, that is of the blade incidence angle relatively to the shaft, that could be obtained continuously and that could be completely automatic. Another object of the present invention is to realize a variable-pitch propeller, having an extremely simply structure, wherein the propeller pitch will adapt automatically and efficiently to the different dynamic conditions to which the propeller is subjected while it is operating.

SUMMARY OF THE INVENTION

These and other objects are obtained by the variable-pitch propeller according the first independent claim and the following independent claims.

The variable-pitch propeller, according to the present invention, comprises at least one blade rotatably pivoted to a cylindrical casing of the propeller, a shaft being coupled to an engine and coaxial to the propeller casing, a kinematic system, coupled to the shaft or to the propeller casing and to the afore mentioned blade, adapted for regulating the rotary motion of the blade around its own pivot axis to the propeller casing, and preferably adapted to transform the rotary motion of the shaft in such a rotary motion of the blades, as well as means for transmitting the rotary motion of the shaft to the propeller casing, such a propeller being likewise shaped to provide at least one not null angular range for the free relative rotation of the blade, around its pivot axis relatively to the propeller casing itself, or vice versa. In addition the propeller comprises advantageously at least one elastic element directly or not directly countering the relative rotation of the blade relatively to the propeller casing, or vice versa.

According to such an invention, as will be evident to a person skilled in the art, the afore mentioned angular range of free rotation of the blade (or blades) relatively to the propeller casing, or vice versa, might be alternatively obtained between the blade and the afore mentioned regulating kinematic system constrained to the shaft, or between the shaft and the transforming kinetic system constrained to the blade, or also, as it will be after better explained, between the shaft and the propeller casing so as to allow the blade rotation, or blades, around its own pivot axis upon the shaft rotating, in such a angular range, relatively to the propeller casing.

It would be also noticed that it might be provided more than one angular range of free rotation of the blade around its own pivot axis, relatively to the propeller casing, being variously disposed between the afore mentioned components.

Thanks to the use of an elastic element countering the relative blade (or blades) rotation relatively to the propeller casing, also in a indirect mode, in a propeller of the type afore described, the afore mentioned angular range of free rotation of the blade relatively to the propeller casing, or vice versa, is clearly visible according to the forces acting to the elastic element itself: upon increasing the forces acting on such an elastic element, the latter will allow a greater relative rotation of the blade (or blades) relatively to the propeller casing, with a consequent increase of the rotation angle of the blade (or blades) relatively to the propeller casing itself (and thereby the decrease of the propeller pitch), whereas upon decreasing of such forces, the elastic element will allow a smaller relative rotation of the blade (or blades) relatively to the propeller casing, and rather, thanks to its spring-back, it will can push the shaft and/or the blade (or blades) in a corresponding position having a reduced rotation angle of the same blade (or blades) (and thereby increasing the propeller pitch).

In absence of external forces or motive powers acting on the elastic element, the latter, thanks to the spring-back to its initial not deformed position, will push the blade, or the blades, in a "rest" position, corresponding to a reduced rotation angle of the blade, or blades, relatively to the propeller casing, and thereby to a great propeller "base" pitch, which pitch in theory will can be infinite or defined, for example, in the projecting step of the propeller.

According to a preferred aspect of the present invention, such a "base" pitch, that corresponds to the rest situation of the propeller blades not being stressed by external or internal forces, might be changed/regulated thanks to an auxiliary device manually operated, of the type described in EP 0 328 966 A1, for example, that is adapted to change/regulate the initial blade angle relatively to the propeller casing, according to what is user determined, or according to the extemporary navigation conditions.

It might be observed that from the choice of a correct base pitch of the propeller blades also (and above all) depends the obtainment of optimal navigation conditions. Using such an auxiliary device for manually regulating the base pitch in a propeller of the herein claimed type, that allows the user to easily set such a base pitch, enables to obtain such an optimal navigation conditions without difficult theoretical calculations too.

In a characteristic embodiment of the present invention, the elastic element, preferably formed by a cylindrical spiraled flexing spring, is placed such that the spring ends might be integral with the propeller casing and the shaft, respectively, and the axis of such a spring is parallel or coincident with the propeller axis.

According to a different aspect of the present invention, the afore said regulating kinematic system is composed of a hub, directly or indirectly coupled to the shaft, that is shaped to provide an angular range of free relative rotation of the shaft relatively to the hub itself and then of the blades relatively to the shaft and the propeller casing. Within such an angular range is placed the afore said elastic element countering the free rotation of the shaft relatively to the hub (and then of the blades relatively to the propeller casing), able to exercise a force on said regulating kinematic system that is countering to the blade (or blades) rotation from their afore said "rest" position.

In another embodiment of the present invention, the blade (or blades) are pivoted on the propeller casing and are constrained to the regulating kinematic system of the rotary motion of the blade itself such as to have an angular range, not null, of free rotation of the blade around its own axis, relatively to such a kinematic system. The interposition of an elastic element countering the blade rotation relatively to the afore said regulating kinematic system, and then indirectly in relation to the shaft and the propeller casing, allows to automatically obtain a different pitch of the propeller according to the forces acting on the same blade (or blades). Indeed, upon changing the external forces acting on the blade (that is the resistant torque), and according to the countering element elastic coefficient, it will change the potential angle of relative rotation of the blade relatively to the regulating kinematic system: upon increasing of such a resistant torque, the elastic reaction force of the countering element and such a resistant torque are balanced by a greater relative rotation angle of the blade (or blades) relatively to the regulating kinematic system, and then relatively to the propeller casing itself, with consequent decrease of the propeller pitch, whereas upon decreasing the resistant torque on the blade on the contrary we will have the force balance in correspondence of a smaller rotation angle of the blade (or blades) relatively to the regulating kinematic system, and then relatively to the propeller casing, with a consequent increase of the propeller pitch.

BRIEF DESCRIPTION OF THE DRAWINGS

For purposes of illustrations and not limitative, some preferred embodiment of the present invention will be provided with reference to the accompanying drawings, in which.

DETAILED DESCRIPTION OF SOME EMBODIMENTS OF THE PRESENT INVENTION

Figure 1:
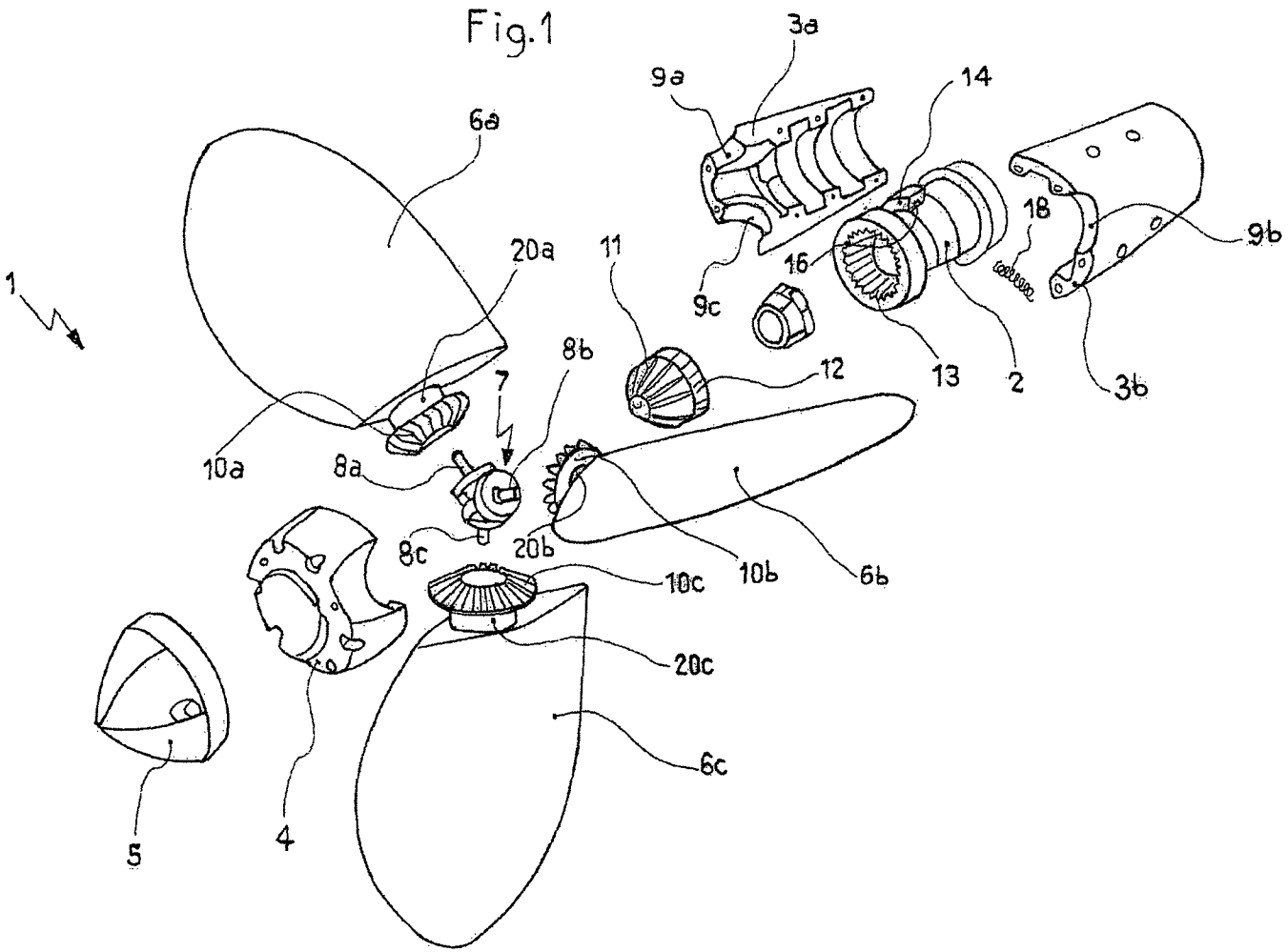
FIG. 1 shows a partial and schematic exploded view of a propeller according to a particular aspect of the present invention.
Figure 2:
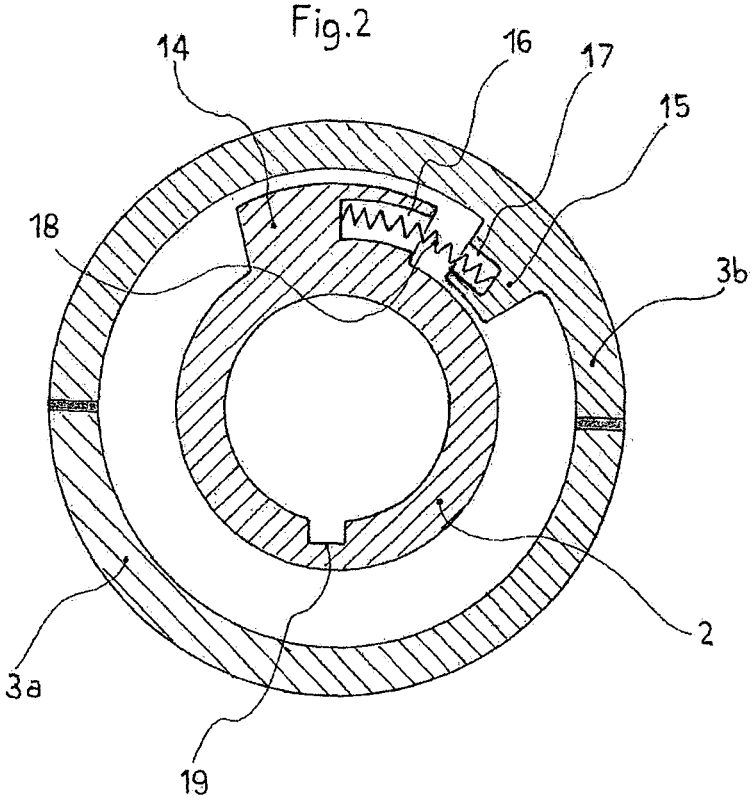
FIG. 2 is a section view, crossing the propeller axis, of the coupling portion between a sleeve coaxially integral to the shaft and the propeller hub of FIG. 1.

Referring to FIGS. 1 and 2, is shown a propeller 1 of the variable-pitch type, able to arrange in a feathered position, preferably for sailing boats. Such a propeller 1, according to a particular aspect of the present invention, is composed of, similarly to the propeller described in IT 1 052 022, a hollow cylindrical casing 3*a*, 3*b*, 4, divided in two semi-shell 3*a*, 3*b* interfixed by bolts (not shown), for example, and protected by a cylindrical end 4 lid, a tip 5, as well as a shaft (not shown), driven by an adapted engine and integral to a sleeve 2, that is coaxially coupled to the cylindrical casing 3, 3*b*, 4 itself, so as to allow, as later explained, the rotary motion transmission from the shaft to the cylindrical casing 3*a*, 3*b*, 4 itself.

Once assembled, the cylindrical casing 3*a*, 3*b*, 4 has circular openings 9*a*, 9*b*, 9*c*, in which pins 20*a*, 20*b*, 20*c* are rotatably housed, being integral at one of their ends to the corresponding blades 6*a*, 6*b*, 6*c* of the propeller 1, that obviously lie outside such a cylindrical propeller casing 3*a*, 3*b*, 4.

Every pin 20*a*, 20*b*, 20*c* similarly has, at its own free end, a toothed truncated bevel pinion 10*a*, 10*b*, 10*c* of a maximum diameter bigger than the opening 9*a*, 9*b*, 9*c* diameter, housed in a chamber (not shown) obtained within the propeller casing 3*a*, 3*b*, 4 itself, substantially at the afore said cylindrical lid 4. The pins 20*a*, 20*b*, 20*c*, and then the pinions 10*a*, 10*b*, 10*c*, are furthermore joined by a central casing 7 provided with lockpins 8*a*, 8*b*, 8*c*, which fit in holes axially obtained within the same pinions 10*a*, 10*b*, 10*c*, such that the pins 20*a*, 20*b*, 20*c* are able to freely rotate relatively to the same lockpins 8*a*, 8*b*, 8*c*.

The sleeve 2, to which the shaft might be integrally constrained by a slot 19 and a corresponding key, otherwise that could be simply an end of the same shaft, is provided with a frontal circular opening 13, internally grooved, that is intended for engaging a crown wheel 12, integral to a truncated bevel pinion 11, for realizing a integral constrain between that pinion 11 and the boat shaft.

The truncated bevel pinion 11 engages permanently the pinions 10*a*, 10*b*, 10*c* of the corresponding blades 6*a*, 6*b*, 6*c*, within the chamber obtained in the cylindrical propeller casing 3*a*, 3*b*, 4, such that the pinion rotation 11 relatively to the cylindrical propeller casing 3*a*, 3*b*, 4 causes the corresponding rotation of the pinions 10*a*, 10*b*, 10*c*, and then the rotation of the blades 6*a*, 6*b*, 6*c*, around the corresponding pin 20*a*, 29*b*, 20*c* axes, or vice versa. Such a rotation of each blade 6*a*, 6*b*, 6*c* around its own pivot axis to the cylindrical propeller casing 3*a*, 3*b*, 3*c* causes the variation of the relative incidence angle and then of the propeller pitch 1.

In consequence, the free relative rotation of the shaft, or identically of the sleeve 2, relatively to the cylindrical propeller body 3*a*, 3*b*, 4, causes the pinion 11 rotation and then the rotation of the pinions 10*a*, 10*b*, 10*c* and of the corresponding blades 6*a*, 6*b*, 6*c*, according to an angle that obviously is a function of the relative rotation angle between the sleeve 2 and the cylindrical propeller casing 3*a*, 3*b*, 4.

The pinion 11, the pinions 10*a*, 10*b*, 10*c*, with the corresponding pins 20*a*, 20*b*, 20*c*, as well as the central casing 7, form a kinematic system, integral not only with the blades 6*a*, 6*b*, 6*c*, but similarly with the boat shaft thanks to the constrain between the sleeve 2 and the crown wheel 12 of the same pinion 11, for regulating the motion of the blades 6*a*, 6*b*, 6*c*, particularly adapted for transforming the shaft circular motion in the circular motion of such a blade 6*a*, 6*b*, 6*c*, around their corresponding pivot axis to the cylindrical propeller casing 3*a*, 3*b*, 4.

The sleeve 2 comprises furthermore a driving tooth 14, externally protruded and perpendicular to the propeller axis 1, disposed to engage a corresponding driven tooth 15, internally obtained within the cylindrical propeller casing 3*a*, 3*b*, 4, and perpendicular too to the propeller axis 1. The driving tooth 14 and the driven tooth 15 are substantially coplanar.

Between the two teeth 14 and 15, thanks to their reduced angular extension, is provided some circumferential distance that, when the two teeth 14, 15 are not reciprocally engaged, allows the free relative rotation of the sleeve 2, and then of the shaft, relatively to the cylindrical propeller casing 3*a*, 3*b*, 4 for some angular range.

Such a circumferential distance between the teeth 14 and 15, respectively integral to the shaft and the cylindrical casing 3*a*, 3*b*, 4 of the propeller, thanks to the kinematic system 7, 10*a*, 10*b*, 10*c*, 11, 12, 20*a*, 20*b*, 20*c* for transforming the rotary motion of the shaft (or the sleeve 2 that is integral with the latter) in the rotary motion of the blades 6*a*, 6*b*, 6*c* around their pivot axis to the propeller casing 3*a*, 3*b*, 4, determines a not null angular range of free rotation of the blades 6*a*, 6*b*, 6*c*, around their pivot axis relatively to the propeller casing 3*a*, 3*b*, 4. Indeed, the rotation of such a blades 6*a*, 6*b*, 6*c* causes, when the distance between the teeth 14 and 15 is not null, the free shaft rotation relatively to the propeller casing 3*a*, 3*b*, 4 itself, thereby allowing the blades 6*a*, 6*b*, 6*c* to rotate around their pivot axis without, in this case, inducing any propeller casing 3*a*, 3*b*, 4 rotation, and then of the same blades 6*a*, 6*b*, 6*c* around the rotation axis of the shaft.

In the particular embodiment shown in FIGS. 1 and 2, the teeth 14 and 15, respectively integral to the sleeve 2 and to the cylindrical propeller casing 3*a*, 3*b*, 4 of the propeller 1, as well as the sleeve itself 2, form the means for transmitting the circular motion from the shaft to the cylindrical propeller casing 3*a*, 3*b*, 4.

According to the present invention, between the teeth 14 and 16 is interposed at least one elastic element 18 countering the relative rotation of the shaft, that is of the sleeve 2, relatively to the cylindrical propeller casing 3*a*, 3*b*, 4, and vice versa.

Particularly, as it could be seen from FIG. 2, such an elastic element might be composed of an helical cylindrical torsion spring 18, whose ends are constrained to the driving tooth 14 and to the driven tooth 15 respectively, thanks to their integral engagement in corresponding housings 16 and 17 obtained on the teeth 14 and on the teeth 15 respectively.

The spring 18, by countering to the relative rotation of the sleeve 2 relatively to the cylindrical propeller casing 3*a*, 3*b*, 4, causes the variability of the relative angular displacement of the sleeve 2 relatively to the cylindrical propeller casing 3*a*, 3*b*, 4, and then of the angular displacement of the pinion 11, integral to the sleeve 2, of the pinions 10*a*, 10*b*, 10*c* and of the blades 6*a*, 6*b*, 6*c*, as a function of the forces acting on the spring 18, and then as a function of the shaft torque and the resistant torque that, by the blades 6*a*, 6*b*, 6*c*, is transmitted to the cylindrical propeller casing 3*a*, 3*b*, 4 itself. Therefore, thanks to the spring 18, the angular range of free rotation of the shaft (and then of the sleeve 2) relatively to the cylindrical propeller casing 3*a*, 3*b*, 4, is variable as a function of the operating conditions of the propeller 1, and obviously, of the elastic characteristic of the spring 18 itself.

More in detail, because the free relative rotation angle between the driven shaft and the cylindrical propeller casing 3*a*, 3*b*, 4, as understood, specifies the pinion 11 rotation angle and then, correspondingly, upon the external conditions change, and specifically the resistant torque on the blades 6*a*, 6*b*, 6*c*, and then the torque, the rotation angle of pinions 10*a*, 10*b*, 10*c* and of the corresponding blades 6*a*, 6*b*, 6*c* will change the elastic response of the spring 18 correspondingly, and consequently the possible angle of shaft rotation will change relatively to the cylindrical propeller casing 3*a*, 3*b*, 4, and we will have a different and continuous rotation of the blades 6*a*, 6*b*, 6*c*, with a corresponding variation of their incidence angle relatively to the shaft, upon changing of such an external conditions.

In addition, because such a blades 6*a*, 6*b*, 6*c* are constrained to the cylindrical propeller casing 3*a*, 3*b*, 4 freely rotating around their pivot axis and are furthermore rotationally integrally constrained to the shaft, or to the hub 2, thanks to the kinematic system 7, 8*a*, 8*b*, 8*c*, 10*a*, 10*b*, 10*c*, 11, when the torque would fail, the fluid dynamic stresses acting on the blades 6*a*, 6*b*, 6*c*, and moreover the spring-back action of the spring 18 to its undeformed shape, will tend the shaft, or the sleeve 2, to rotate to an initial position wherein the teeth 14 and 15 are spaced of a predetermined angular range and, thanks to the kinematic system 7, 8*a*, 8*b*, 8*c*, 10*a*, 10*b*, 10*c*, 11, the blades themselves 6*a*, 6*b*, 6*c* are rotated to their "rest" position, determined in the projecting step. As mentioned before, in the propeller 1 herein shown, particularly adapted in the sailing boats, such a rest position coincides to the "feathered" position, that is the position wherein such a blades 6*a*, 6*b*, 6*c* are disposed so as to present the less fluid dynamic resistance is possible.

It has to be observed that, if the propeller 1 would be of the type used in the motorboats, as yet observed, such a "rest" position might correspond to a predefined position of the blades relatively to the hub, so as to obtain a "base" pitch of such a propeller, for example determined in the projecting step, not infinite.

According to a particular aspect of the present invention, such a "base" pitch might be rendered adjustable by the user due to an auxiliary device manually operated, adapted to vary such a blades 6*a*, 6*b*, 6*c* initial pitch.

For example, such an auxiliary device might comprise a kinematic system adapted to change the initial angular distance, that is the angular range that occurs when the torque and the resistant torque are absent, between the teeth 14 and 15, of the sleeve 2 and the propeller casing 3*a*, 3*b* respectively, according to what the user decided.

Such a device, if it is implemented in the embodiment of FIG. 1 of the present invention, for example might comprise a slider that is slidingly axially constrained on the sleeve 2 of the shaft and having a sloped guide relatively to the axis shaft for a corresponding checking stop integral with the propeller casing 3*a*, 3*b*, 4, so that according to the axial position reached by such a slider, for example manually operable by servo-controls in themselves known in the art, the initial relative angular position between the propeller casing 3*a*, 3*b*, 4 and the sleeve itself 2 could change, that is between the corresponding teeth 15 and 14.

Alternatively, the afore mentioned auxiliary device for manually changing the base pitch of the propeller 1 could comprise, if adapted to the embodiment of FIG. 1, an auxiliary truncated bevel pinion coaxially mounted to the shaft and adapted to engage, at the pinion 11 opposite side, the pinions 10*a*, 10*b*, 10*c* for rotationally operating the blades 6*a*, 6*b*, 6*c* relatively to the propeller casing 3*a*, 3*b*, 4, such a pinion determining the initial angular position of the blades 6*a*, 6*b*, 6*c*, and then the afore said "base" pitch, according to its angular position, the latter being determined, for example, by a rotation driving slider of such an auxiliary pinion.

Or more, between the sleeve 2 and the central pinion 11 might be interposed a slider that is axially sliding relatively to the sleeve 2 itself and provided with a sloped guide relatively to that sleeve 2 axis. The slider, manually operable by the user, engages furthermore a tooth integral with the pinion 11, such that, upon changing the relative position of the slider, that is the corresponding sloped guide, and the central pinion 11 tooth, will change the pinion 11 angular position relatively to the propeller casing 3*a*, 3*b*, 4, and consequently the corresponding angular position of the pinions 10*a*, 10*b*, 10*c* will change. Such an angular position of the pinions 10*a*, 10*b*, 10*c* of the blades 6*a*, 6*b*, 6*c* establishes the initial "rest" position of the same blades 6*a*, 6*b*, 6*c*, that is the propeller 1 base pitch.

Figure 9:
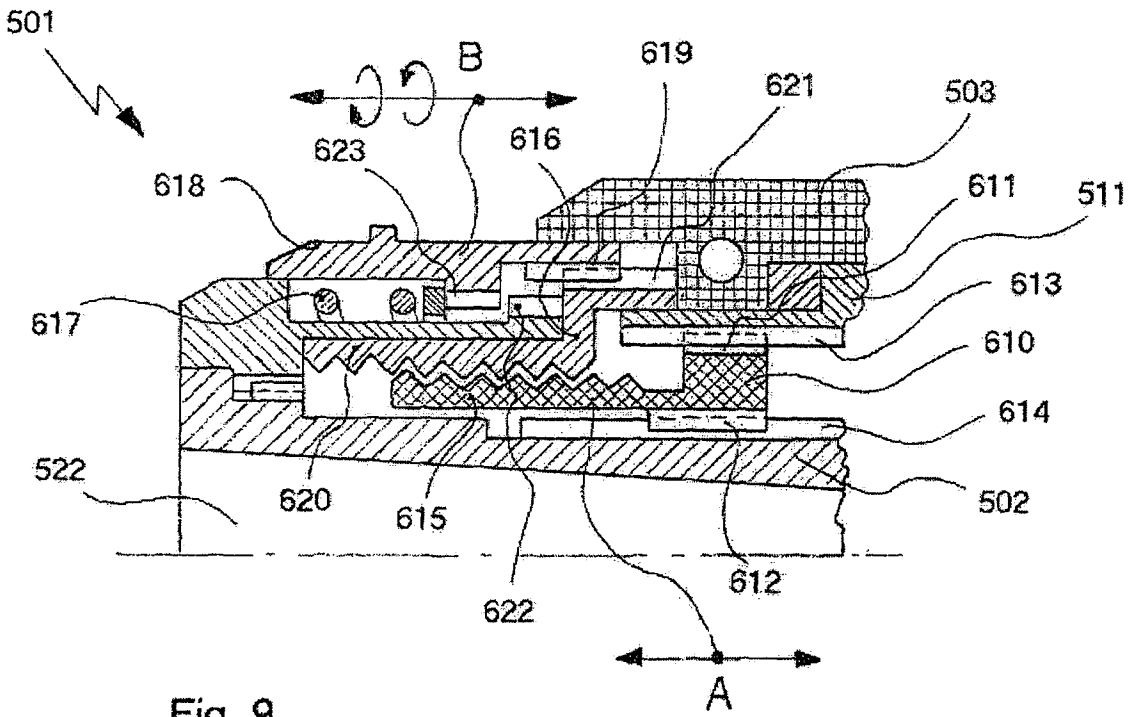
FIG. 9 is a lateral section view, partially cut-away, of auxiliary device to manually regulate the base propeller pitch, according to a preferred aspect of the present invention.

Such a device will be next briefly examined making reference to FIG. 9.

In the preferred embodiment of the present invention shown in FIGS. 1 and 2, the not deformed shape of the spring 18, and its elastic characteristic, allow the sleeve 2, or the relative shaft, to obtain angular positions relatively to the cylindrical propeller casing 3*a*, 3*b*, 4, which allow the blades 6*a*, 6*b*, 6*c* to be disposed in a feathered position (or in any else "rest" position, determined in the projecting step or set by the user due to an auxiliary device for manually varying the base pitch).

Thereby, when the propeller 1 is at rest, that is without an engine torque and a resistant torque on the same propeller 1, and then without forces acting on the spring 18, the teeth 14 and 15 are spaced out by a certain angular range, within which is possible to have the relative free rotation of the sleeve 2, or of the shaft, relatively to the cylindrical propeller casing 3*a*, 3*b*, 4, by overcoming the elastic resistance of the spring 18 itself.

When the torque is re-established, as a matter of fact, we have the free rotation of the sleeve 2 relatively to the cylindrical propeller casing 3*a*, 3*b*, 4, with the consequent mutual approach of the teeth 14 and 15 and spring 18 compression, the rotation stopping when the engine torque, the resistant torque and the spring reaction force are balanced, that causing, thanks to the kinematic system 7, 8*a*, 8*b*, 8*c*, 10*a*, 10*b*, 10*c*, 11, an appropriate rotation of the blades 6*a*, 6*b*, 6*c*, starting from their feathered position (or "rest" position), to greater incidence angles.

Furthermore it has to be noticed that, during the pitch 1 operation, in case the resistant torque and the engine torque will decrease, the forces acting on the spring 18 would decrease and then the spring 18, due to its spring-back, would tend to drift the teeth 14 and 15 apart, thereby causing a rotation, counterwise, of the pinion 11, with the relative rotation counterwise of the blades 6*a*, 6*b*, 6*c* to smaller incidence angles.

On the contrary, upon incrementing the resistant torque, the forces acting on the spring 18 would increase, thereby causing its compression and the further rotation in approach of the two teeth 14 and 15, with the corresponding rotation of the blades 6*a*, 6*b*, 6*c* to greater incidence angles. Synthetically, the operation of the propeller 1, shown in FIGS. 1 and 2, is as follows.

Starting from a position in which the spring 18 is in its not deformed shaped, or it is balanced by the force transmitted through the kinematic system 7, 8, 10*a*, 10*b*, 10*c*, 11*a*, 11*b*, 11*c* by the blades 6*a*, 6*b*, 6*c*, and wherein the driving tooth 14 is spaced from the driven tooth 15 by some angular range, the torque application to the shaft and then to the sleeve 2 causes the relative rotation of the sleeve 2 relatively to the cylindrical propeller casing 3*a*, 3*b*, 4, and then it causes the driving tooth 14 to approach the driven tooth 15, overcoming the resistance offered by the spring 18, and thereby causing its compression.

Such a relative rotation of the sleeve 2 in relation to the cylindrical propeller casing 3*a*, 3*b*, 4, which remains substantially stationary when the shaft starts because of inertia and external frictions, thanks to the engagement of the circular grooved opening 13 of the sleeve 2 with the crown wheel 12, causes the pinion 11 rotation and consequently the pinions 10*a*, 10*b*, 10*c* and the corresponding blades 6*a*, 6*b*, 6*c* rotation relatively to the cylindrical propeller casing 3*a*, 3*b*, 4 to greater incidence angles.

When the torque of the resistant type due to the fluid action on the blades 6*a*, 6*b*, 6*c*, and the deformation resistance offered by the spring 18, are balanced, the approaching of the tooth 14 to the tooth 15 is stopped in a certain mutual angular position of the sleeve 2 relatively to the cylindrical propeller casing 3*a*, 3*b*, 4, the spring 18 will not compress anymore, acting rigidly, and we will have thereby the rotary motion transmission from the sleeve 2, that is from the shaft, to the cylindrical propeller casing 3*a*, 3*b*, 4, with the consequent blade 6*a*, 6*b*, 6*c* rotation stopping around their pivot axis to the cylindrical propeller casing 3*a*, 3*b*, 4.

In case the reached balance conditions would fail, for example because of a resistant torque increase, then the spring 18 would be subjected to a greater force that could cause an additional compression, with a corresponding additional approach of the teeth 14 and 15 and relative shaft rotation in relation to the cylindrical propeller casing 3*a*, 3*b*, 4. Such a relative shaft rotation in relation to the cylindrical propeller casing 3*a*, 3*b*, b4, would cause the pinion 11 rotation in the same initial sense and then the blades 6*a*, 6*b*, 6*c* rotation to further greater incidence angles.

On the other hand if the balance conditions would fail due to a decreasing of the resistant torque, then the forces acting on the spring 18 could be smaller and this would cause some extension of the spring 18 and the corresponding mutual spreading apart of the teeth 14 and 15. Such a spreading, as yet seen, would cause the relative rotation, in the counterwise to that above described, of the shaft relatively to the cylindrical propeller casing 3*a*, 3*b*, 4 and the rotation, counterwise too, of the pinion 11 and of the blades 6*a*, 6*b*, 6*c* to smaller incidence angles.

At last, when the torque fails, we have the rest arrangement (for example, in the "feathered" position) of the blades 6*a*, 6*b*, 6*c*, as previously described.

Figure 3A:
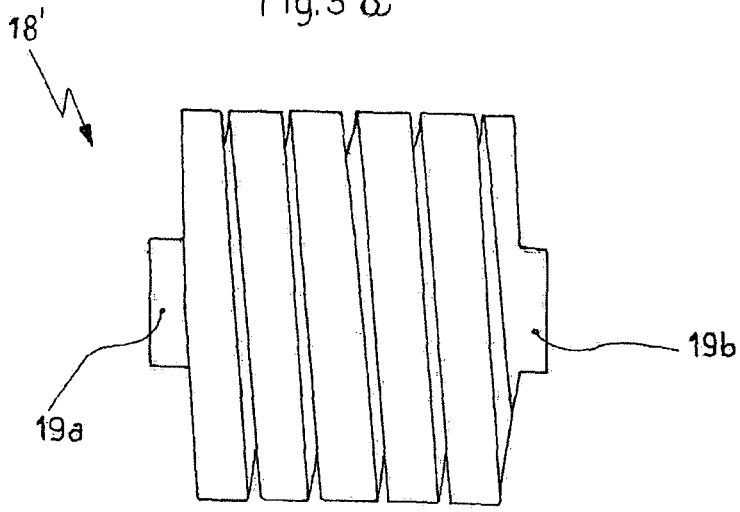
FIG. 3*a* is a lateral view of a particular spring able to be used in another propeller according to the present invention.

FIG. 3*a* shows an elastic element countering the relative rotation of the shaft relatively to the propeller hub (cylindrical casing), according to a particular aspect of the present invention, that is composed of a helical cylindrical flexing spring 18'. Such a spring 18', for example directly interposed between the propeller hub and the shaft, so as to present its own parallel or coincident axis to the propeller axis, allows furthermore the direct transmission of motion across the hub and the shaft, without the necessary presence of two teeth substantially lying over the same plane.

As a matter of fact the spring 18' presents its ends 19*a*, 19*b* adapted to integrally engage rotationally the propeller hub and shaft according to the present invention, such that the relative rotation between the shaft and the hub is obstructed by the elastic resistance to the flexing deformation of such a spring 18'.

Figure 3B:
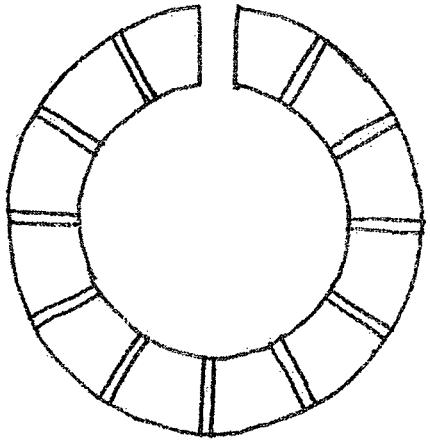
FIG. 3*b* is a plant view of another particular spring able to be used in a propeller according to the present invention.
Figure 3C:
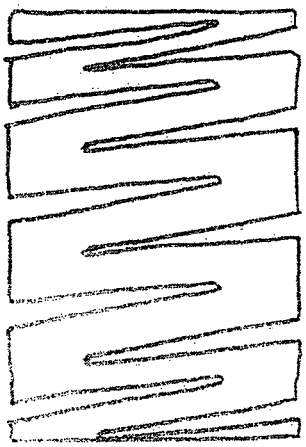
FIGS. 3*c* and 3*d* are lateral views in extended configuration of two different embodiments of the spring depicted in FIG. 3*b;*
Figure 3D:
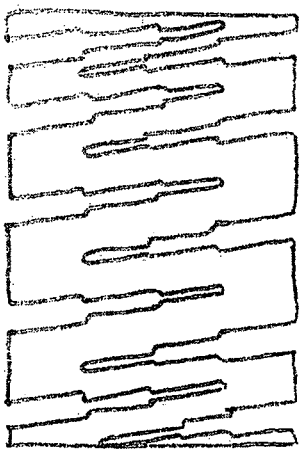

FIGS. 3*b*, 3*c* and 3*d* show other elastic elements countering the relative rotation of the shaft in relation to the propeller hub, usable in a propeller according to the present invention. It is a flat spring, having cross notches that could have different shapes (as, for example, in the two embodiments of the FIGS. 3*c* and 3*d*), conveniently folded to form an elastic compass, which ends might be respectively constrained to the propeller casing (hub) and the shaft (or to the sleeve integral to it) of a propeller, such as for example the type shown in the FIGS. 1 and 2.

Similarly to the propeller of FIGS. 1 and 2, in this case too, only subsisting the balance conditions between engine torque, resistant torque and elastic resistance of the spring 18', it could be obtained, after a shaft relative rotation relatively to the hub of some angular range, and the consequent blade rotation so that to change the pitch propeller itself, the transmission of the shaft rotary motion to the hub (propeller casing) itself.

In a particular embodiment of the present invention not shown, particularly adapted for using with a spring 18' disposed with its own axis parallel to the propeller axis, known means might also be foreseen, such for example a claw clutch rotationally integral with the hub or the shaft, but being able to axially shift relatively to these latter, to change the preload of the spring 18' itself. In this case, one of the ends 19*a* or 19*b* of the propeller 18' is constrained to slide integrally to such a clutch, which axial shifting relatively to the hub, or the shaft, to which it is coupled, caused by the operator, establishes the preload of the same spring 18'.

It has to be pointed out that, as it will be evident to a person skilled in the art, any other elastic element countering the relative rotation of the shaft relatively to the hub, or vice versa, such as for example a deformable polymeric block, or a wire spring or a metallic flat spring, might be used in the propeller 1 afore described, or in any other propeller according to the present invention, without therefore leaving the protection scope of the present invention.

Now making reference to FIG. 4, another embodiment of the present invention will be described wherein the afore mentioned angular range of free relative rotation between the blades 106*a*, 106*b*, 10*c* and the propeller casing 103*a*, 103*b*, 104 is obtained between the shaft 102, 122 and the afore said kinematic system for transforming the rotary motion of the shaft 102, 122 in the rotary motion of the blades 106*a*, 106*b*, 106*c* around their pivot axis 120*a*, 120*c* to the propeller casing 103*a*, 103*b*.

The propeller 101 is composed of a sleeve 102, integrally rotationally constrained, for example by a key, to the shaft 122 of the boat, a propeller casing 103*a*, 103*b*, 104, composed of two semi-shells 103*a*, 103*b* interfixed by bolts (not shown), for example, and a cylindrical end 104 lid, and three blades 106*a*, 106*b*, 106*c* pivoted freely of rotating within the corresponding recesses peripherally defined on the propeller casing 103*a*, 103*b*, 104 itself. The sleeve 102, differently from the sleeve 2 of the propeller 1, is rigidly constrained, that is it is fixed, to the propeller casing 103*a*, 103*b*, 104 such that it could not freely rotate relatively to the latter.

The propeller casing 103*a*, 103*b*, 104, frontally delimited by a tip 105, defines a chamber within a kinematic system 111, 112, 107, 110*a*, 110*b*, 110*c* is placed, for regulating the rotary motion of the blades 6*a*, 6*b*, 6*c* around the corresponding pin 120*a*, 120*c* axis by which the propeller casing 103*a*, 103*b*, 103*c* are constrained.

More specifically, such a kinematic system comprises, for each blade 106*a*, 106*b*, 106*c*, a truncated-bevel pinion 110*a*, 110*b*, 110*c*, extending into the chamber defined inwardly of the propeller casing 103*a*, 103*b*, 104, and being constrained to the relative blade 106*a*, 106*b*, 106*c* by two pins 120*a*, 120*c*. The pinion 110*a*, 110*b*, 110*c* diameters is obviously greater than the housing hole diameter for the pins 120*a*, 120*c* of the blades 106*a*, 106*b*, 106*c* defined in the propeller casing 103*a*, 103*b*, 104, so that to prevent, once the propeller casing 103*a*, 103*b*, 104 is assembled, the eventual disengagement of the blades 106*a*, 106*b*, 106*c* from the propeller casing 103*a*, 103*b*, 104 itself.

The free end of the truncated-bevel pinions 110*a*, 110*b*, 110*c* of the blades 106*a*, 106*b*, 106*c* are drilled opportunely for their mutual engagement to the same pins 108*a*, 108*b*, 108*c* of a central casing 107, rendering the same blades 106*a*, 106*b*, 106*c* rotationally interlocked.

The afore said truncated-bevel pinions 110*a*, 110*b*, 110*c* engage also a central pinion 111, that is truncated-bevel too, and in turn coupled to the sleeve 102, and then to the shaft 122. The rotation of the truncated-bevel pinion 111 around its axis relatively to the propeller casing 103*a*, 103*b*, 104 causes the concurrent, and identical rotation, due to the pinion 110*a*, 110*b*, 110*c* equality and the central casing 107, of the blades 106*a*, 106*b*, 106*c* around the axes of the corresponding pins 120*a*, 120*c*.

In the same manner the propeller described in reference to the FIGS. 1 and 2, and as mentioned yet, the pinions 110*a*, 110*b*, 110*c*, 111 and the pins 120*a*, 120*c* and the central casing 107, 108*a*, 108*b*, 108*c* set up the kinematic system for regulating the rotary motion of the blades 106*a*, 106*b*, 106*c* around their pivot axis to the central casing 103*a*, 103*b*, 104 of the propeller.

Advantageously, the coupling between the central pinion 111 and the sleeve 102 is realized by a spring 118, preferably a cylindrical helical spring acting in flexing, whose ends are fixed to the ends of a toothed ring 121 respectively, whose angular arrangement relatively to the sleeve 102 ends establishes the preload of the spring 118 itself, and the major base of the truncated-bevel pinion 111.

The spring 118 constitutes the afore said elastic element countering the relative rotation of the blades 106*a*, 106*b*, 106*c* relatively to the propeller casing 103*a*, 103*b*, 104.

More particularly, as evident in FIG. 3, the free end of the sleeve 102, that is opposite from the shaft 122, presents an internal toothed surface within the toothed ring 121 is fitted, the latter being in turn constrained, at the surface facing the central pinion 111, to a spring 118 end. The other end of the spring 118 is constrained to the end ring nut 112 of the same central pinion 111, so that such a spring 118, once obtained the balance between the external forces acting on the pinion 111 through the blades 106*a*, 106*b*, 106*c*, the external forces generating the resistant torque acting on the same blades 106*a*, 106*b*, 106*c*, and the elastic reaction force of the same spring 118, can form a rigid constrain between the sleeve 102 and the pinion 111. The angular arrangement of the toothed ring 121 in the internal surface, toothed too, of the sleeve 102, in the case the spring 118 is a flexing spring having a cylindrical helix with the ends constrained to the ring nut 112 and the ring 121 respectively, will determine the preload of the spring itself 118, as afore mentioned.

The spring 118 presence, conveniently designed about stiffness constant and geometrical dimensions, so that to elastically deform as a function of the resistant torque acting on the blades 106*a*, 106*b*, 106*c*, allows the automatic changing of the angular position of the same blades 106*a*, 106*b*, 106*c* around their pivot axis 120*a*, 120*c* to the propeller casing 103*a*, 103*b*, 104, with the consequent changing of the propeller casing 101 itself. In presence of considerable forces (and then of resistant torque), the spring 118 will allow a great rotation of the blades 106*a*, 106*b*, 106*c* around their pivot axis, with a propeller 101 pitch reducing, whereas upon failing of the external forces, the spring-back of spring 118 will cause the reduction of such a rotation angle of the blades 106*a*, 106*b*, 106*c* around their pivot axis, with a consequent increase of the propeller 101 pitch.

It has to be observed that, in case the sleeve 102 and the propeller casing 103*a*, 103*b*, 104 shape provide the existence of an angular not null range of free rotation of the same sleeve 102 relatively to such a propeller casing 103*a*, 103*b*, 104, similarly to the propeller, for example of the type described in IT 1 052 002, the spring 118 might act as a transmission element of the rotary motion between the shaft 122, or better the sleeve 102, and the central pinion 111, with a consequent rotation of the pinions—of the planetary type—110*a*, 110*b*, 110*c*, and of the corresponding blades 106*a*, 106*b*, 106*c*, when the sleeve 102 itself is free rotating relatively to the propeller casing 103*a*, 103*b*, 104.

In this latter event, the angular range too of free rotation of the sleeve 102 relatively to the propeller casing 103*a*, 103*b*, 104 might be filled by an elastic element countering the shaft 122 rotation relatively to the propeller casing 103*a*, 103*b*, 104.

Figure 5:
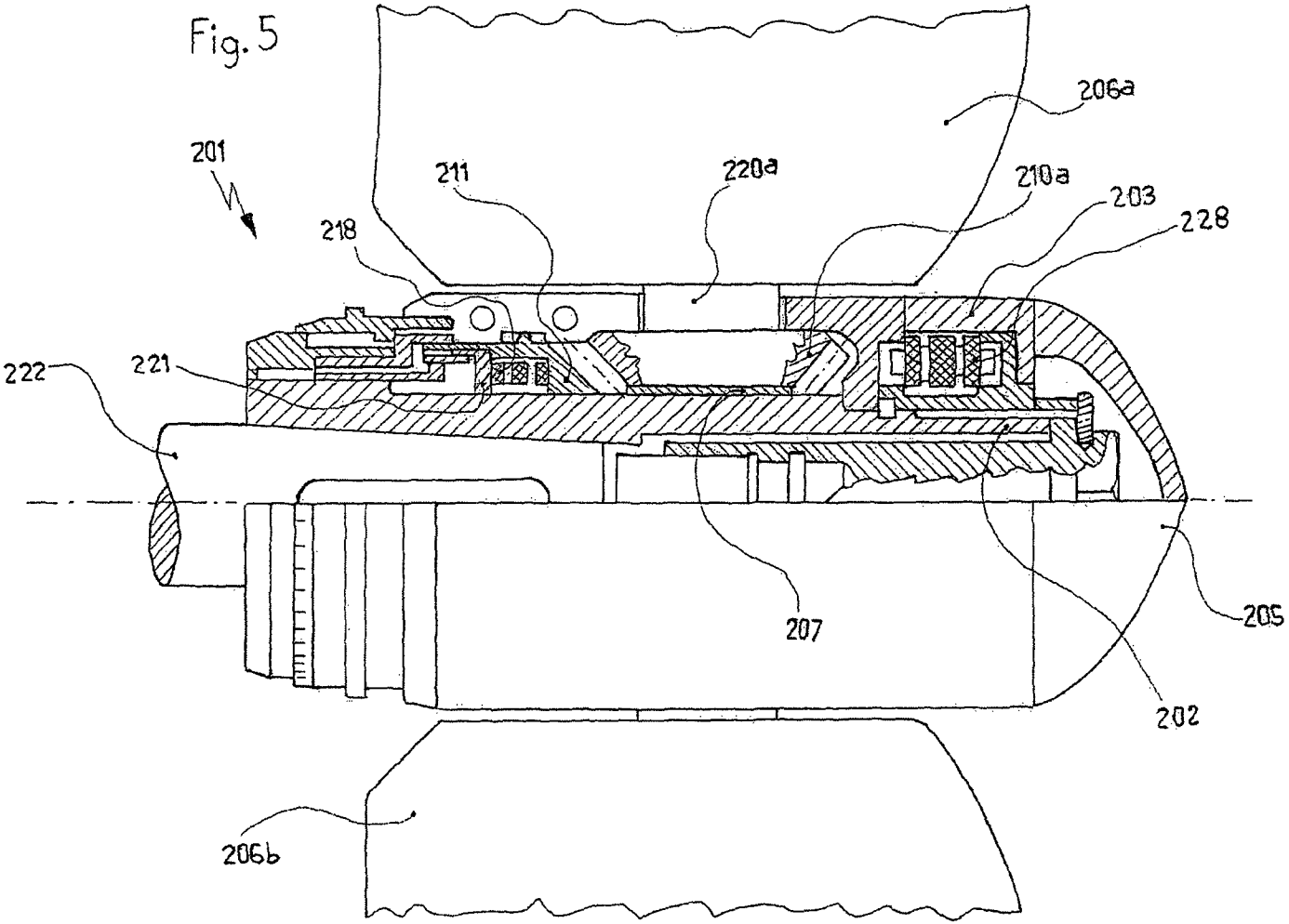
FIG. 5 is lateral partially cut-away view of a propeller according to a different embodiment of the present invention.

This is the case of the propeller 201 outlined in FIG. 5. Such a propeller 201 provides as a matter of fact that between the sleeve 202, being rotationally integral to the shaft 222, and the propeller casing 203 there should be an angular free rotation range of the shaft 222 itself relatively to the propeller casing 203, wherein an elastic countering element 228 is present, for example of the type shown in reference to FIG. 3, adapted to elastically counter such a free rotation of the sleeve 202 relatively to the propeller casing 203.

It has to be observed that such a spring 228, differently from the springs 18, 118 above described, is placed in "astern" position of the propeller 201, that is near the tip 205.

Furthermore the propeller 201 is composed of, similarly to the propellers 1, 101 above described, a kinematic system to transform the rotary motion of the shaft 222 in the rotary motion of the blades 206*a*, 206*b* around their pivot axis relatively to the propeller 203.

Such a kinematic system provides a central truncated-bevel pinion 211 that is rotationally constrained to the shaft 222 by the ring 221 and engaged to the truncated-bevel planetary pinions 210*a*, in turn constrained by the pins 220*a* to the blades 206*a*, 206*b* and mutually by a central casing 207, of the casing 107 type afore described.

Figure 4:
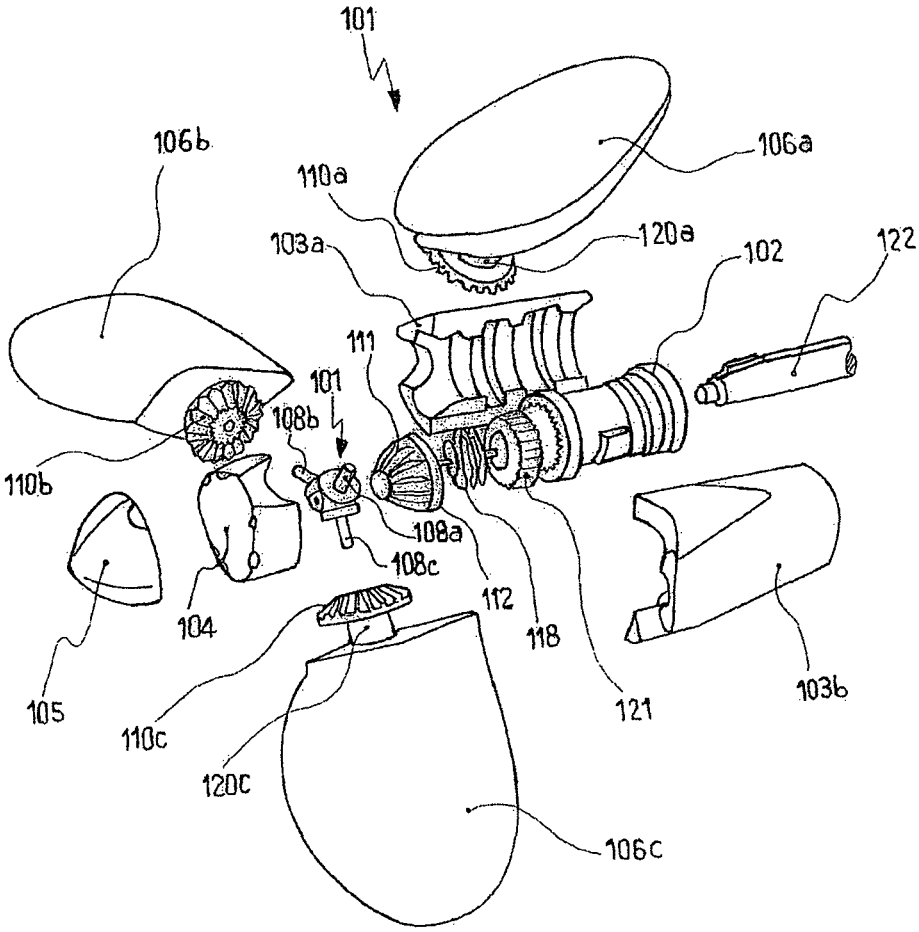
FIG. 4 shows a partial and schematic exploded view of another propeller according to a further aspect of the present invention.

Similarly to the propeller 101 of FIG. 4, a spring 218 is placed between the ring 221 rotationally integral to the shaft 222 and the central pinion 211, the spring being adapted to counter the rotation of the central pinion 211 itself and then the planetary pinions 210*a*, and ultimately the blades 206*a*, 206*b* around their corresponding pins 220*a*.

In this case too, similarly to propeller 1 of FIGS. 1 and 2 case, the springs 218 and 228 allow the automatic regulation of the propeller 201 pitch according to the resistant torque acting on the blades 206*a*, 206*b*, to different system frictions and to the torque transmitted to the shaft 222.

Figure 6:
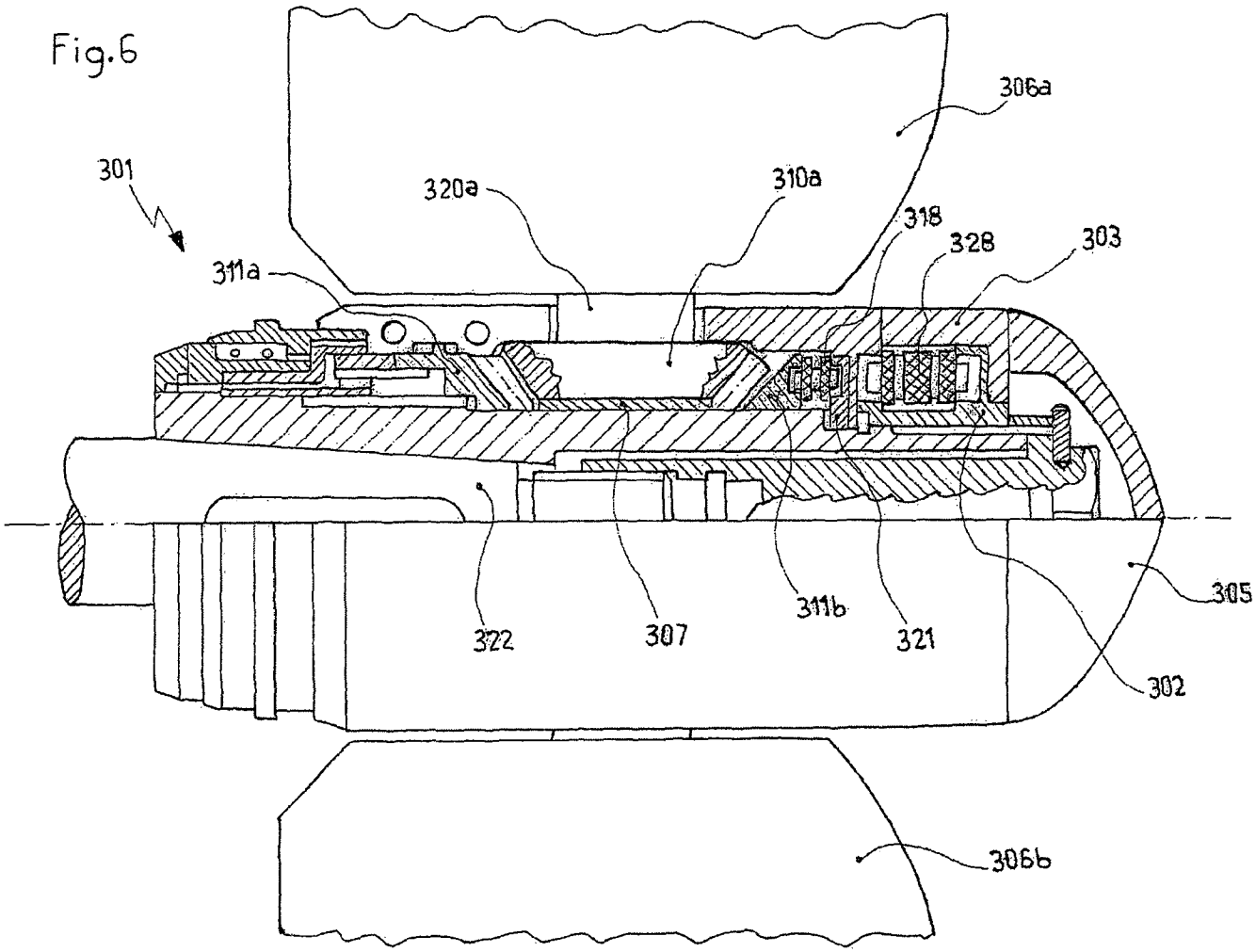
FIG. 6 is a lateral partially cut-away view of another propeller according to another embodiment of the present invention.

The propeller 301 represented in FIG. 6 is a variation, operationally similar, of the propeller 201 shown in FIG. 5.

Such a propeller 301, similarly to the propeller 201, provides that the transforming kinematic system 307, 310*a*, 311*a*, 311*b*, 320*a* of the rotary motion of the shaft 322 in the rotary motion of the blades 306*a*, 306*b* around their pivot axis to the propeller casing 303, would be coupled to the same shaft 322, or better to the sleeve 302 integral to the latter, by interposing an elastic countering element 318, completely similar in operations to the elastic element 218 of the propeller 201.

Such an elastic element 318, preferably composed of a helical cylindrical flexing spring, is constrained between a ring nut 321 integral to the sleeve 302 and a central pinion 311*b* rotationally constrained to the sleeve 302 itself. Differently from the propeller 201, the elastic element 318 is placed in "astern" position of the same propeller 401, that is next the tip 305 thereof. In addition, the transforming kinematic system of such a propeller 301, differently to the propeller 201, provides the presence of two coaxial and specular central truncated-bevel pinions 311*a*, 311*b*, both engaged to the truncated-bevel pinions 310*a* of the blades 306*a*, 306*b*, and rotationally constrained to the sleeve 302 of the shaft 322.

Furthermore such a sleeve 302 is coupled, in presence of an angular range of free relative rotation, to the hollow cylindrical casing of the propeller 303 by a spring 328, by analogy with the spring 218 of the propeller 201 described in reference to the FIG. 5.

The propeller 301 operation is completely similar to the operation of the propeller 201 above described.

Figure 7:
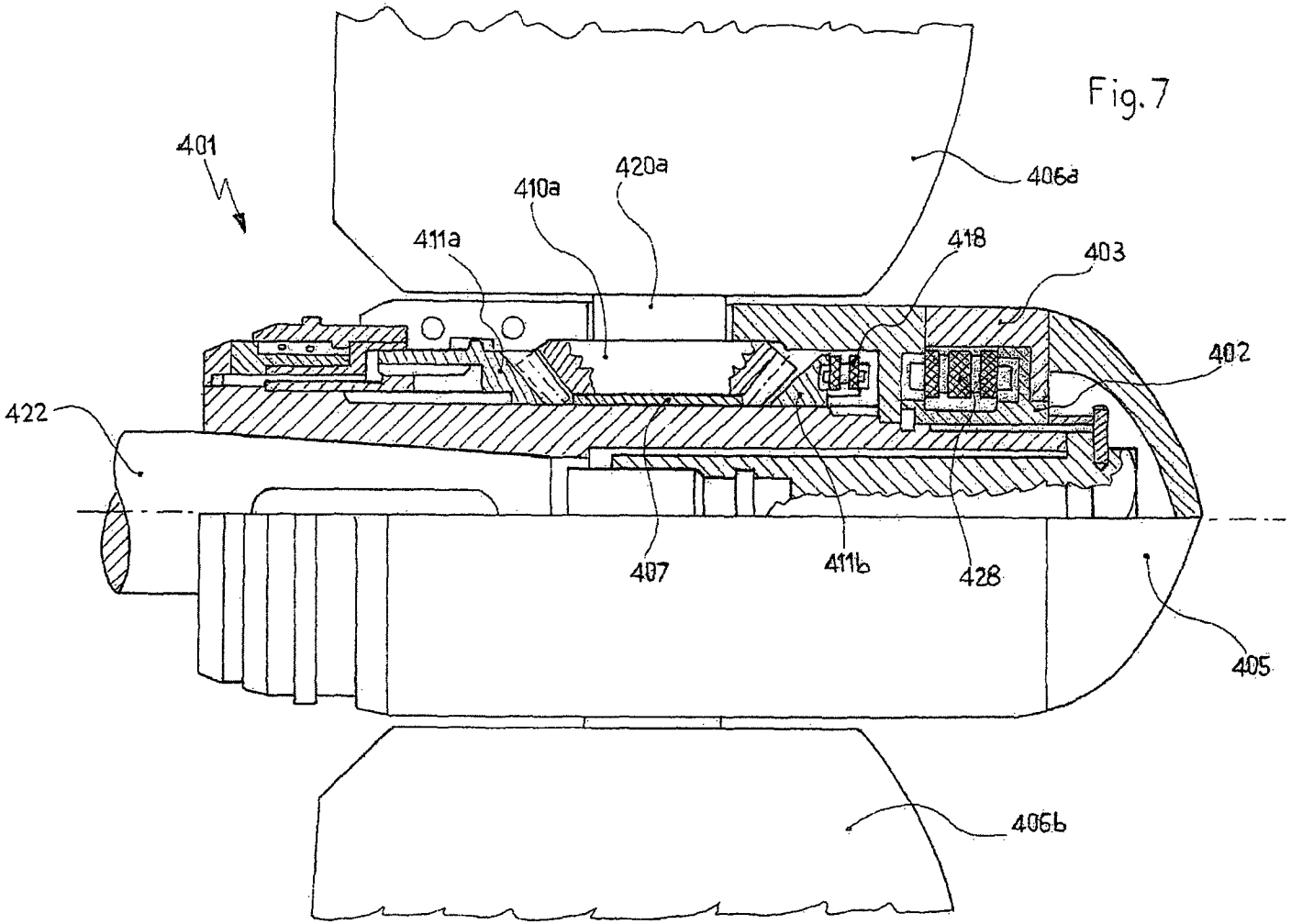
FIG. 7 is a lateral partially cut-away view of a further propeller according to another different embodiment of the present invention.

The propeller 401, schematically shown in FIG. 7, is a variation of the propeller 201 functional scheme above reported. Such an propeller 401, similarly to the propeller 1 or 201, is composed of a shaft 422 rotationally integral to a sleeve 402, that is coupled to the hollow cylindrical casing of the propeller 403 by the spring 428 interposition, extending into an angular range of free relative rotation of the sleeve 402 relatively to the propeller casing 403. In this case too, the spring 428 is placed next the tip 405 of the propeller 401. For the detailed operation of such a propeller 401 portion, the reader could make reference to what described relating to the propeller 1 in FIGS. 1 and 2.

The propeller 401, similarly to the propeller 1 or 101 or 201, is furthermore composed of a kinematic system 411*a*, 411*b*, 410*a*, 420*a*, 407 for regulating the rotary motion of the blades 406*a*, 406*b* around their own pivot axis to the propeller casing 403. Such a kinematic system is composed of two central truncated-bevel pinions 411*a*, 411*b* coaxial and rotationally coupled to the propeller casing 403 by the spring 418 interposition, the planetary pinions 410*a*, truncated-bevel too, that are integral to the blades 406*a*, 406*b* by the pins 420 connecting to the propeller casing 403, and a central casing 407 for the materially connection between such a planetary pinions 410*a*.

The spring 418, reciprocally constraining at least one of the two central pinions 411*a*, 411*b* to the cylindrical propeller 403 casing, has the same function of the spring 218 of the propeller 201 above mentioned.

Such a spring 418, indeed, is elastically countering the rotationally displacement of the blades 406*a*, 406*b* around their own pivot axis to the propeller 403 casing, standing the external stresses to the propeller 401 transmitting from the blades 406*a*, 406*b*, through the planetary pinions 410*a*, to the central pinions 411*a*, 411*b*.

The spring 418 and the spring 428 are the afore mentioned elastic element countering the rotation of the blades 406*a*, 406*b* around their pivot axis and acting so that to allow the propeller 401 pitch increasing, that is a smaller rotation angle of the blades 406*a*, 406 relatively to the casing 403, in presence of a not exaggerated resistant torque acting on the same blades 406*a*, 406*b* and, vice versa, the propeller 401 pitch decreasing in case of increasing of such a resistant torque.

Figure 8:
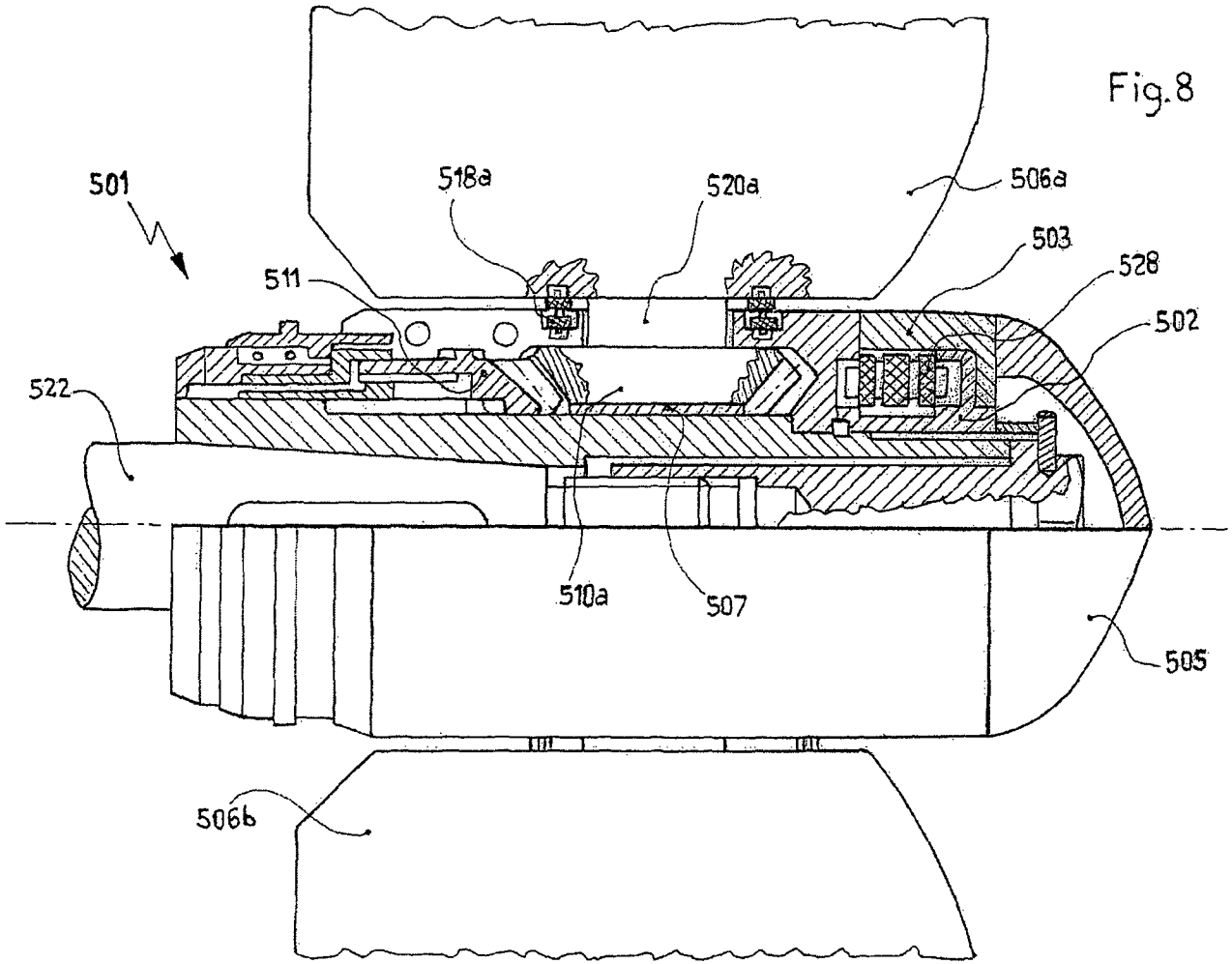
FIG. 8 shows a lateral partially cut-away view of another propeller according to a further aspect of the present invention.

FIG. 8 shows a propeller 501 according to another preferred embodiment of the present invention.

Such a propeller 501, similarly to the propeller 201 of FIG. 5, shows a shaft 522 kinematically coupled, by interposition of a sleeve 502, to a propeller 503 cylindrical casing, on which the blades 506*a*, 506*b* are pivoted 520*a* of the propeller 501 itself.

Between the sleeve 502 and the propeller casing 503 is provided an angular not null range of free relative rotation of the same sleeve 502 relatively to the casing 503, and vice versa, wherein a spring 528 is placed, preferably a helical cylindrical flexing spring, of the type shown in FIG. 3, adapted to counter such a free rotation of the sleeve 502 relatively to the casing 503. Such a spring 528 is placed next the tip 505 of the spring 503, similarly to the spring 201.

For an operating description of such a spring 528 it has to be referred to the spring 218 operating description of the propeller 201 in FIG. 5.

The propeller 501, similarly to the propeller 1 of FIG. 1, in furthermore composed of a kinematic system 511, 520*a*, for regulating the rotary motion of the blades 506*a*, 506*b* around their pivot axis to the casing 503, adapted to transform the relative rotation of the shaft 522, or better of the sleeve 502, relatively to the same cylindrical casing of the propeller 503, in the blades 506*a*, 506*b* rotation around the axis of the corresponding pins 520*a* for constraining such a propeller 503 casing.

Differently from the propeller 1, 101, 201, 301, 401 afore described, the propeller 501 provides the presence, for each blade 506*a*, 506*b*, of a spring 518*a*, for example of the helical torsion type, adapted to counter the rotary movement of the corresponding blade 506*a*, 506*a* relatively to the propeller casing 503. Such a spring 518*a*, constrained to its end to the propeller casing 503 and to its own blade 506*a*, 506*b*, as schematically shown in FIG. 8, is countering such a rotation of the corresponding blade 506*a*, 506*b* so that to allow, in a controlled way by the spring 518*a* itself, a greater slope of the blade 506*a*, 506*b*, and then a smaller propeller 501 pitch, upon increasing of the resistant torque acting on the blade 506*a*, 506*b*.

FIG. 9 shows a particular auxiliary device to change manually the "base" propeller pitch, that is the tilt angle of the blades 506*a*, 506*b* in a "rest" position, of a propeller 501 of the exemplary type shown in FIG. 8.

In short, such a device provides the slider 615 interposition, axially shiftable, between the sleeve 502 to which is keyed the shaft 522 and the central truncated-bevel pinion 511, coaxial to the shaft 522, that is responsible for the motion transmission between the sleeve 502 (that is the shaft 522) and the pinion 511, and whose axial position, as it will be explained, determines the angular position of the pinion 511 relatively to the sleeve 502 itself.

More specifically, FIG. 9 shows a detail of the propeller 501, of the type represented in FIG. 8, comprising a cylindrical casing 503 of the propeller keyed on the shaft 522 by a sleeve 502, provided with an auxiliary device for manually changing the "base" propeller pitch, that is composed of a slider 610 coaxially and slidingly mounted on the sleeve 502 and interposed between the latter and a central truncated-bevel pinion 511 adapted to drive, by its engagement with the planetary pinions 510 of the blades 506*a*, 506*b* of the propeller 501, the blades 506*a*, 506*b* rotation of the propeller 501 relatively to the propeller 503 cylindrical casing.

The slider 610 is provided with a first straight groove 611, having a parallel axis to the shaft 522 axis (and then of the propeller 501), disposed to house a rib 613 integral to the central pinion 511, and radially projected from the latter, and a further groove 612, for example of straight shape, disposed to house a tooth 614 helical and integral to the sleeve 502.

The helical shape of the tooth 614 (or alternatively of the groove 612) and furthermore the straight shape with parallel axis to the propeller 501 axis of the rib 613, cause the relative rotation of the pinion 511 relatively to the sleeve 502 during the sliding of the slider 610 along the two senses shown with A in FIG. 9, and then, because of the integral constrain, relatively to the cylindrical propeller casing 503.

The pinion 511 rotation causes the rotation of the planetary pinions 510*a* of the blades 506*a*, 506*b* of the propeller 501 that are engaged to the same pinion 511, with a consequent rotation of the same blades 506*a*, 506*b* around their pivot axis to the cylindrical casing 503 of the propeller and then the manual changing of the "base" propeller 501 pitch.

It has to be noticed that, any the desired user axial position the slider 610 should have, and then any the selected "base" pitch 501 propeller should be, because of the slider 610 causes the sleeve 502 motion transmission (that is from the shaft 522) to the central pinion 511, such a position does not cause changes of free rotation angular range between the sleeve 502 itself and the propeller casing 503, that remains unchanged upon changing the "base" pitch and the same the preload of the spring 528 placed between the sleeve 502 and the cylindrical casing 503 remains unchanged.

The slider 610 shift of the propeller 501 is regulated by driving mechanical means composed of a casing 616 coaxially and rotationally mounted on the sleeve 502, and composed of two cylindrical portions of different diameter, one of which, the smaller diameter one, comprises an internal threading 620 acting as a nut thread for an external threading 615 of which a back protuberance is provided with, cylindrical too, of the slider 610. Because of the arrangement and the constrains between these components, the threadings 620 and 615 build up a thread and nut thread assembly, by which the casing 616 rotation around the propeller 501 axis, relatively to the shaft 522 and then to the cylindrical casing 503, determines the forward or backward movement of the slider 610 along such a propeller 501 axis, and thereby to each angular position reached by such a casing 616 corresponds a determined axial position of the slider 610, with a consequent relative angular positioning of the central pinion 511.

Such a rotation or better saying angular displacement of the casing 616, in the particular embodiment shown in FIG. 9, is driven by the roto-translation B of an annular slider 618, coaxially mounted on the cylindrical casing 513, and provided with a tooth 619 integrally and rotationally engaging into a housing 621 of which the cylindrical portion having the greater diameter of the casing 616 is provided with. Such an annular slider 618 is in addition composed of a positioning and holding tooth 623, that engages a rack 622 integral to the cylindrical casing 503 of the propeller 501. Such a positioning tooth 623 is maintained fitted in the rack 622 by a return spring 617 extending between the cylindrical casing 503 and such a tooth 623. When the tooth 623 is engaged into the rack 622 obviously any rotation of the slider 618 around the propeller 501 axis is not possible.

Furthermore, as evident, the engagement of the positioning tooth 623 into the rack 622 happens only at the grooves of the latter defined in the projecting step, that is only for predetermined angular positions reached by the tooth 623 relatively to the rack 622 and then only for well defined angular positions of the slider 618 relatively to the cylindrical casing 503 of the propeller 501. That means that, opportunely spacing the grooves of the rack 622 in the projecting step (that is defining the teeth dimensions of such a rack 622), it is possible to allow the user to rotate the slider 618 to discrete and predefined angular positions only, to which obviously will correspond some well defined axial positions 610 only that will cause, due to the angular position reached by the central pinion 511 of rotation regulation of the blades 506*a*, 506*b*, the initial angular arrangement of the same blades 506*a*, 506*b* relatively to the propeller 501 casing 503 in predefined positions in projecting step exclusively.

This allows the exactly and immediately evident user regulation of the "base" propeller 501 pitch.

As evident in FIG. 9, however the shift of the slider 618 leaving the frontal portion of the propeller 501, countering the propeller 617 action, causes the disengagement of the tooth 623 from the rack 622, with a consequent possibility for the user of rotating—in the predefined angular rack 622 position only—the slider 618, held shifted, around the propeller 501 axis, with the relative rotation of the casing 616 around the latter axis. Therefore such a rotation of the slider 618 determines the casing 616 rotation, the consequent shift of the slider 610—in discrete positions predefined by the slider 618 reached positions only—, and at last the changing of the propeller 501 pitch, according to what user defined.

Once the user desired angular position is reached, and allowed by the corresponding tooth 623 engagement into the rack 622, the disengagement of the slider 618 causes, thanks to the return spring 617, the fitting of the tooth 623 in the rack 622, and thereby the locking, in the desired angular position relatively to the propeller 503 casing, of the slider 618. This causes, as above mentioned, the locking in a well defined axial position, desired by the user and allowed by the tooth 623 and rack 622 coupling, of the slider 610 to which corresponds, thanks to the regulating kinematic system of blade rotation, a well defined angular position of the propeller 501 blades relatively to the cylindrical casing 503, and so a predefined fluid dynamic pitch for the propeller 501 itself.

The tooth 623 of the slider 618, the corresponding rack 622 integral with the cylindrical casing 503 of the propeller, as well the clutch 619, 621 operated thread, allowing the axial slider 610 arrangement in discrete and predefined positions only, form a driving kinematic positioning system of said slider 610 in predefined discrete positions.

Thanks to such a kinematic system the user is able to accurately regulate the propeller 501 base pitch, easily and exactly, by rotating the corresponding blades 506*a*, 506*b* according to angular ranges predefined in the projecting step, and to immediately know, for example by an optical indicator—having preferably checking marks—the angular position reached by the slider 618 relatively to the cylindrical casing 503 of the propeller, the blade rotation angle, relatively to the propeller 501 axis, and then the base pitch of the same blades 506*a*, 506*b*, obtained by such a driving means.

In addition, in case would became necessary to modify the base propeller 501 pitch during the navigation, because of the different resistant torque acting on the blades 506*a*, 506*b* mainly, such a kinematic system 618, 619, 620, 621, 622, 623 for driving the slider 610 position will allow to accurately reposition the blades 506*a*, 506*b* relatively to the propeller 503 casing and thereby to change the propeller 501 base pitch in the user desired correct position, easily and exactly, while changing the external conditions on the propeller 501 itself.

It has to be noticed that the auxiliary device for manually changing the propeller base pitch of FIG. 9, although above mentioned as applied to the propeller 501 in FIG. 8, might be for example likewise applied to the propellers represented in FIGS. 1, 5, 6 and 7, through little changes well known to the person skilled in the art.

Thereby, to obtain an optimal base pitch, starting from which the present invention allows the automatic and extemporary pitch change according to the varied external conditions, the user, after noticed the real navigation values in the given conditions (for example still sea, medium load on the boat, clean bottom . . . ) with predefined base pitch, might change, thanks to the auxiliary device above described, the propeller base pitch to obtain the optimal base pitch, by consecutive approximations.

Such a regulating procedure of the propeller base pitch, aided by the user friendly auxiliary device for manually regulating the pitch of the afore described type, thereby allows the propeller of the present invention to automatically and very easily determine the best navigation conditions for the boat which is coupled to.

The invention claimed is:

1. A variable-pitch propeller comprising at least one blade rotatably pivoted to a propeller casing, a shaft being coupled to an engine and coaxial to said propeller casing, a kinematic system coupled to said shaft, or to said propeller casing, and to said at least one blade, for regulating the rotary motion of said at least one blade around its own pivot axis to said propeller casing, to vary the pitch, as well as means for transmitting the rotary motion of said shaft to said propeller casing, said propeller being shaped to provide at least one not null angular range for the free relative rotation of said at least one blade around its pivot axis relative to said propeller casing, further comprising one elastic element directly or indirectly countering the relative rotation of said at least one blade relative to said propeller casing, wherein the at least one free rotation angular range comprises a free rotation angular range of said shaft relative to said propeller casing, the elastic element countering the relative rotation of the shaft relative to the propeller casing.

2. The propeller according to claim 1, wherein said means for transmitting the motion comprise at least one driving tooth integral to said shaft and rotationally engaging at least one driven tooth that is internally integral to said propeller casing.

3. The propeller according to claim 1, wherein said counteracting elastic element is circumferentially interposed between said driving tooth and said driven tooth.

4. The propeller according to claim 1, wherein said elastic element consisting of one spring that is integral to said shaft and to said propeller casing.

5. The propeller according to claim 4, wherein said consisting of one spring has its own axis parallel to or coincident with the axis of said propeller.

6. The propeller according to claim 5, wherein said consisting of one spring is a flexing spring having a-cylindrical helix.

7. The propeller according to claim 4, wherein said elastic element is a torsion spring having a cylindrical helix.

8. The propeller according to claim 1, wherein at least one free rotation angular range comprises a free rotation angular range of said shaft relatively relative to said regulating kinematic system.

9. The propeller according to claim 8, wherein said regulating kinematic system comprises at least one hub within said shaft housed coaxially, said hub being shaped for providing said at least one not null angular range of relative rotation of said shaft relative to said regulating kinematic system, comprising one elastic element countering the relative rotation of said shaft relative to said hub.

10. The propeller according to claim 1, wherein said regulating kinematic system comprises a kinematic system for transforming the rotary motion of said shaft in the rotary motion of every said blade around its own pivot axis to said propeller casing.

11. The propeller according to claim 10, wherein said kinematic system for transforming the rotary motion of said shaft in the rotary motion of every said blade around its own pivot axis to said propeller casing is of the cam follower type, or pinion and/or gear wheel type.

12. The propeller according to claim 10, wherein said regulating kinematic system for transforming the rotary motion of said shaft in the rotary motion of every said blade around its own pivot axis to said propeller casing comprises at least one first toothed truncated bevel pinion integrally rotating with said shaft, starting from at least a determined angular position of said shaft relative to said kinematic system, and for every said blade, at least one second toothed pinion, or gear wheel, being operatively engaged to said first pinion, said at least one second pinion being integral to the pivot ends to said propeller casing of the corresponding blade.

13. The propeller according to claim 1, wherein at least one free rotation angular range comprises a free rotation angular range of said at least one blade relative to said regulating kinematic system.

14. The propeller according to claim 1, wherein said kinematic system regulates the rotary motion of said at least one blade around its own pivot axis to said propeller casing, said at least one blade and/or said means for transmitting the rotary motion being shaped to increase the propeller pitch while said angular range of relative rotation of said blade decreases relative to said shaft.

15. The propeller according to claim 1, further comprising means for changing a preload of said at least one elastic element.

16. The propeller according to claim 1, further comprising two or more free rotation angular ranges of said at least one blade around its own pivot axis to said propeller casing relative to the latter.

17. The propeller according to claim 1, further comprising at least one auxiliary device for manually regulating the propeller base pitch.

18. The propeller according to claim 17, wherein said kinematic system for regulating the rotary motion of said at least one blade comprises at least one rotating central pinion, coaxial to the axis of said shaft, and kinematically coupled to said one or more blades and in that said auxiliary device comprises a driving kinematic system having a manually controlled activation of said regulating kinematic system, said driving kinematic system comprising at least one slider that is constrained to slide along a direction parallel to that of said shaft and provided with at least one guide for at least one checking stop integrally rotating with said central pinion of said regulating kinematic system, said at least one guide and said at least one checking stop reciprocally engaging along a path that is not parallel to said shaft, while said at least one slider is sliding.

* * * * *

UNITED STATES PATENT AND TRADEMARK OFFICE

CERTIFICATE OF CORRECTION

PATENT NO. : 8,449,256 B2
APPLICATION NO. : 12/520056
DATED : May 28, 2013
INVENTOR(S) : Massimiliano Bianchi It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 983 days.

Signed and Sealed this
Eighth Day of September, 2015

Michelle K. Lee

Michelle K. Lee
*Director of the United States Patent and Trademark Office*